US009574393B2

(12) United States Patent
Huang

(10) Patent No.: US 9,574,393 B2
(45) Date of Patent: Feb. 21, 2017

(54) CORD-WINDING DEVICE FOR A BLIND ASSEMBLY HAVING NO PULL CORD

(71) Applicant: Ya-Ling Huang, Taichung (TW)

(72) Inventor: Ya-Ling Huang, Taichung (TW)

( * ) Notice: Subject to any disclaimer, the term of this patent is extended or adjusted under 35 U.S.C. 154(b) by 0 days.

(21) Appl. No.: 14/802,692

(22) Filed: Jul. 17, 2015

(65) Prior Publication Data

US 2016/0138330 A1 May 19, 2016

(30) Foreign Application Priority Data

Nov. 18, 2014 (TW) ..... 103220450 U

(51) Int. Cl.
*E06B 9/262* (2006.01)
*E06B 9/322* (2006.01)
*E06B 9/323* (2006.01)

(52) U.S. Cl.
CPC ..... *E06B 9/262* (2013.01); *E06B 9/322* (2013.01); *E06B 9/323* (2013.01); *E06B 2009/2625* (2013.01); *E06B 2009/2627* (2013.01); *E06B 2009/3222* (2013.01)

(58) Field of Classification Search
CPC ..... E06B 9/262; E06B 2009/2622; E06B 2009/2625; E06B 2009/2627; E06B 2009/3222
USPC ..... 160/170, 171, 84.04, 84.05
See application file for complete search history.

(56) References Cited

U.S. PATENT DOCUMENTS 5,113,922 A * 5/1992 Christensen ..... E06B 9/32 160/107
5,232,208 A * 8/1993 Braid ..... E05D 13/1276 16/197
5,353,548 A * 10/1994 Westfall ..... E05D 13/1276 16/197
5,477,904 A * 12/1995 Yang ..... B60J 1/2091 160/370.23
6,047,762 A * 4/2000 Anderson ..... B60J 1/2019 160/265
7,398,815 B2 * 7/2008 Liang ..... E06B 9/262 160/170
7,487,817 B2 * 2/2009 Liang ..... E06B 9/32 160/170
9,316,050 B2 * 4/2016 Hsu ..... E06B 9/32
2007/0119547 A1 * 5/2007 Liang ..... E06B 9/32 160/170
2007/0151675 A1 * 7/2007 Nien ..... E06B 9/30 160/84.05
2007/0272364 A1 * 11/2007 Liang ..... E06B 9/322 160/84.05

(Continued)

*Primary Examiner* — David Purol
(74) *Attorney, Agent, or Firm* — Hamre, Schumann, Mueller & Larson, P.C.

(57) ABSTRACT

A cord-winding device for a blind assembly having no pull cord includes a base seat defining a slide channel and having a bottom side configured to removably mount the blind assembly thereto, and an adjustment unit including a slide seat mounted slidably in the slide channel, a plurality of rollers mounted on the base seat and the slide seat, respectively, and a constant force spring having first and second ends respectively fixed to the base seat and the slide seat. A lift cord winds around the rollers and extends through the base seat. The lift cord is configured to extend through the blind assembly after extending through the base seat so as to be positioned to the base seat and the blind assembly.

9 Claims, 7 Drawing Sheets

(56) References Cited

U.S. PATENT DOCUMENTS

| | | | | |
|---|---|---|---|---|
| 2008/0289774 | A1* | 11/2008 | Ying | E06B 9/323<br>160/178.1 R |
| 2014/0069592 | A1* | 3/2014 | Hsu | E06B 9/38<br>160/84.05 |
| 2014/0216664 | A1* | 8/2014 | Hsu | E06B 9/262<br>160/84.02 |
| 2015/0041073 | A1* | 2/2015 | Hsu | E06B 9/262<br>160/192 |
| 2015/0376940 | A1* | 12/2015 | Hsu | E06B 9/322<br>160/169 |

* cited by examiner

CORD-WINDING DEVICE FOR A BLIND ASSEMBLY HAVING NO PULL CORD

CROSS REFERENCE TO RELATED APPLICATION

This application claims priority of Taiwanese Application No. 103220450, filed on Nov. 18, 2014.

FIELD

The disclosure relates to a blind assembly, more particularly to a cord-winding device for a blind assembly having no pull cord.

BACKGROUND

Referring to FIG. 1, a conventional blind assembly having no pull cord is shown to include an upper beam 11 defining a receiving space 111; a blind body 12 disposed on the bottom of the upper beam 11; a fixed seat 13, a movable seat 14 and a cord-winding controller 15 all disposed in the receiving space 111; and a plurality of lift cords 16, each of which passes through the blind body 12 and winds around the fixed seat 13 and the movable seat 14. The cord-winding controller 15 includes a rotating seat 151 having a rotating shaft 150, two torsion springs 152 respectively disposed on two opposite sides of the rotating shaft 150, and a drive cord 153 wound around the rotating seat 151 and having one end fixed to the movable seat 14. When the blind body 12 is pushed or pulled by an external force, the torsion springs 152 provide torsion for driving the rotating seat 151 to wind or unwind the drive cord 153. The drive cord 153, in turn, drives a sliding movement of the movable seat 14 for linking movement of the lift cords 16. An extent to which the blind body 12 is raised or lowered can thus be adjusted. However, during operation, the torsion springs 152 will wind reversely around the rotating shaft 150, resulting in a large deformation thereof, so that the service life of the torsion springs 152 is shortened. Moreover, this conventional blind assembly uses many components and complex coordination among the components, so that the assembly thereof is inconvenient, and the cost is high.

Referring to FIG. 2, another conventional blind assembly is shown to include a tabular support frame 21, a foldable blind body 22 having a top edge mounted to the support frame 21, a pulley seat 23 mounted slidably on the support frame 21, two first pulleys 24 mounted on the support frame 21, two second pulleys 25 mounted on the pulley seat 23, and a tension spring 26 and a lift cord 27 each of which is connected to the support frame 21 and the pulley seat 23. The support frame 21 includes opposite first and second ends 211, 212, a first end cap 213 mounted on the first end 211, and a second end cap 214 mounted on the second end 212 for fixing the tension spring 26. The lift cord 27 has a fixed intermediate section 271 fixed to the first end cap 213, and two cord end sections 272 extending outwardly and respectively from two opposite ends of the fixed intermediate section 271. The cord end sections 272 wind through the first and second pulleys 24, 25, and pass through the support frame 21 and the blind body 22 to be fixed on a lower end of the blind body 22. When the lower end of the blind body 22 is pulled or pushed by an external force, the lift cord 27 is driven to move, the first and second pulleys 24, 25 are driven to rotate, and the pulley seat 23 is driven to slide, so that the tension spring 26 is compressed or uncompressed to raise or lower the blind body 22. Hence, the effect of adjusting the blind body 22 having no pull cord can be achieved. However, the tension spring 26 requires a sufficient tension space. If the apace is too short, the elastic force of the tension spring 26 will be insufficient; and if the space is too long, it will result in elastic fatigue of the tension spring 26. The length of the tubular support frame 21 is thus restricted. Further, when the tension of the tension spring 26 is increased, the elastic force thereof is also increased, so that there is a big difference in the pulling force of the tension spring 26 before and after tensioning. Thus, the pulling force of the tension spring 26 may not be balanced with the weight, of the blind body 22. Moreover, more effort is necessary to pull the blind body 22 downward, so that if excessive force is used to pull down the blind body 22, the blind body 22 may likely get damaged. Hence, the conventional blind assembly is inconvenient to use.

SUMMARY

Therefore, an object of the present disclosure is to provide a cord-winding device for a blind assembly having no poll cord that can alleviate at least one of the drawbacks of the prior arts.

According to the disclosure, a cord-winding device for a blind assembly having no pail cord comprises a base seat, an adjustment unit and a lift cord. The base seat extends along a longitudinal direction and defines a slide channel that extends along the longitudinal direction. The base seat has a bottom side configured to removably mount the blind assembly thereto. The adjustment unit includes a slide seat mounted slidably in the slide channel, a roller set including a plurality of rollers mounted on the base seat and the slide seat, respectively, and a spring unit including a constant force spring that has a first end fixed to the base seat and a second, end fixed to the slide seat. The lift cord winds around the rollers and extends through the base seat. The lift cord is configured to extend through the blind assembly after extending through the base seat so as to be positioned to the base seat and the blind assembly. The lift cord is configured to support the weight of the blind assembly to thereby generate a pulling force to pull the slide seat. The slide seat in turn pulls the constant force spring so that the constant force spring generates a resilient restoring force. The resilient restoring force counteracts the pulling force of the lift cord to achieve a force-balanced state.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
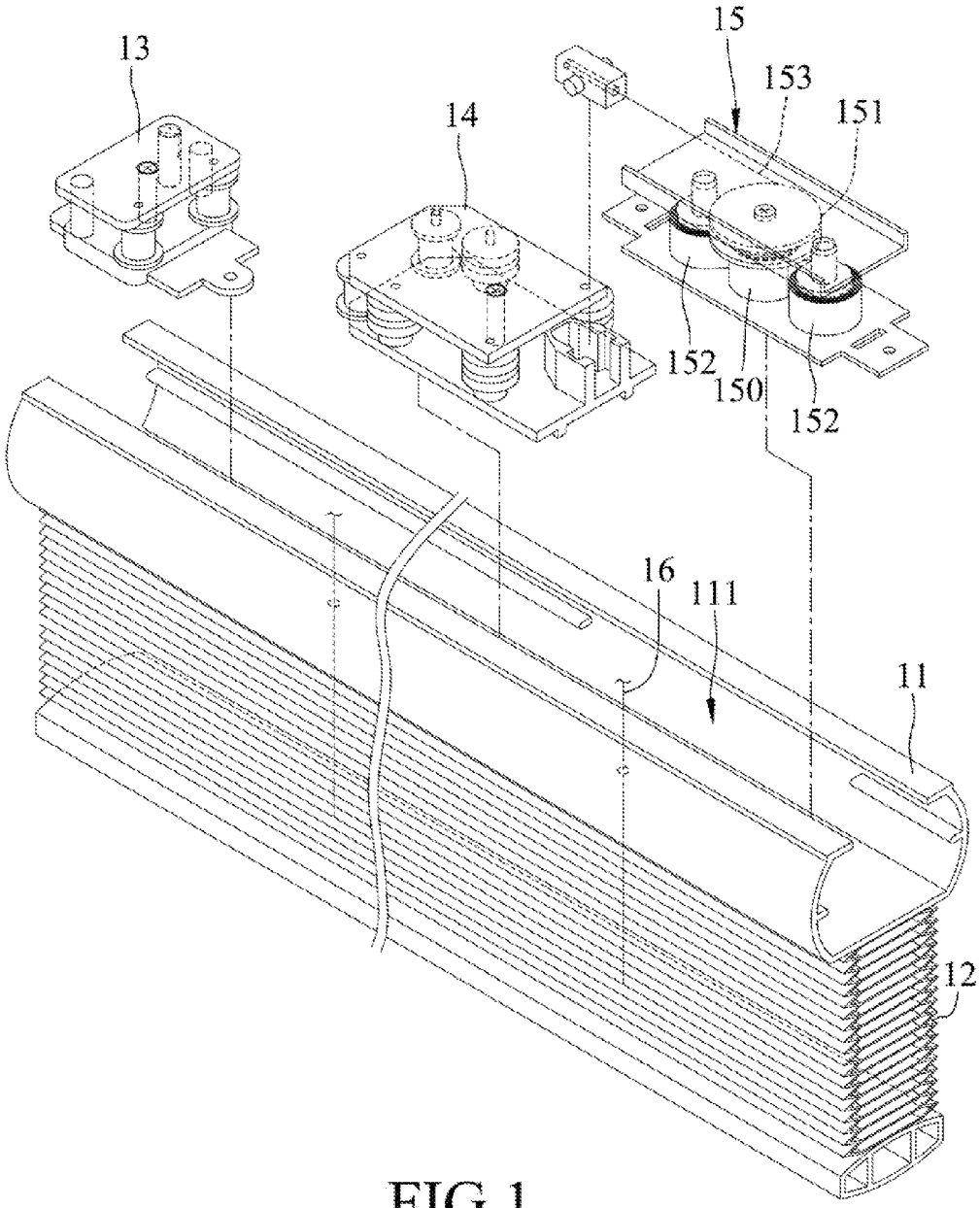
FIG.1 PRIOR ART
FIG. 1 is a partly exploded perspective view of a conventional blind assembly having no pull cord.
Figure 2:
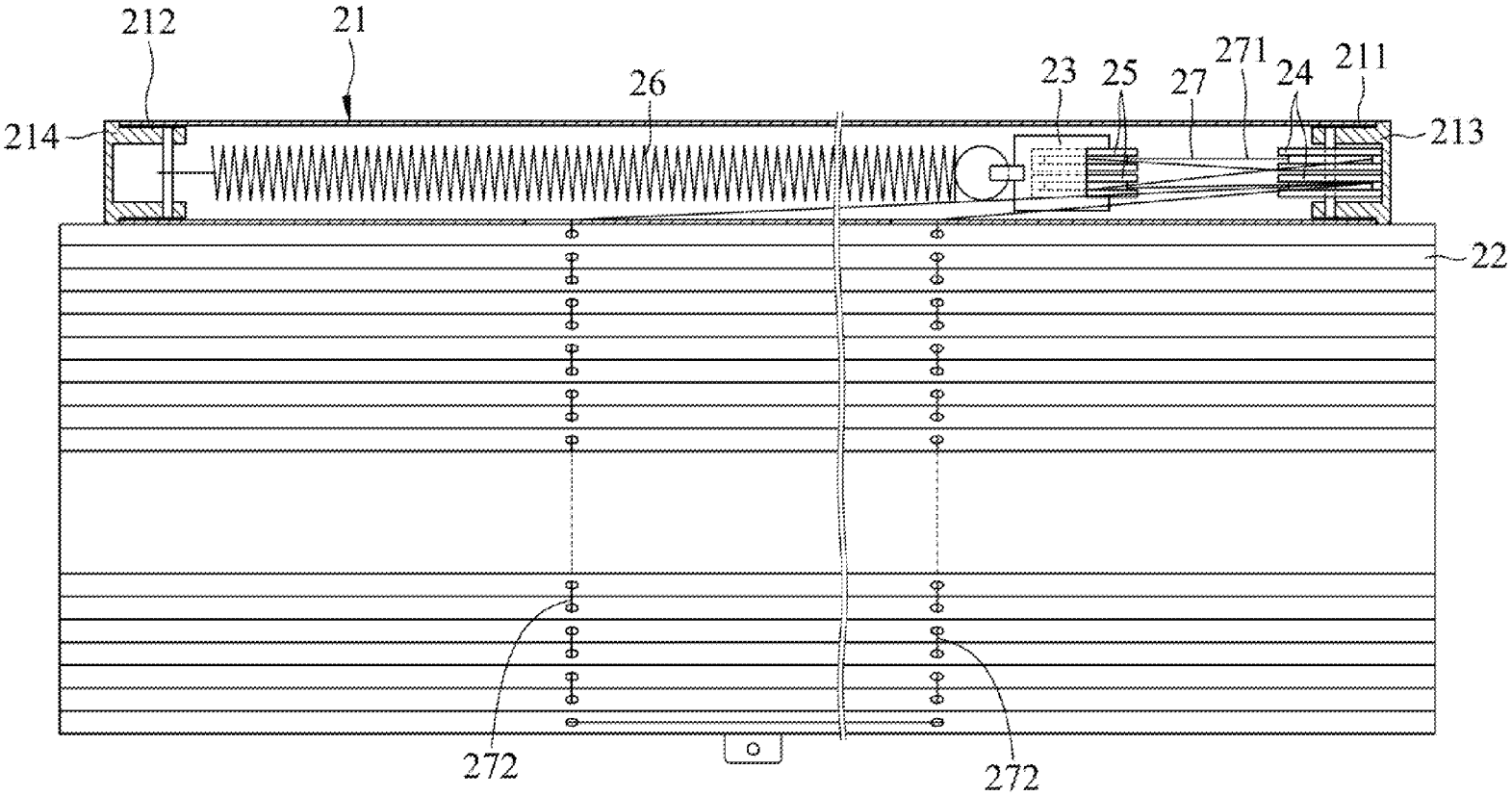
FIG.2 PRIOR ART
FIG. 2 is a sectional view of another conventional blind assembly.

Referring to FIGS. 3 to 7, a cord-winding device according to the embodiment of the present disclosure is suitable for use on a blind assembly 3 having no pull cord. The blind assembly 3 may be a Roman blind, a cellular blind, a pleated blind, or a Venetian blind. The blind assembly 3 includes a blind body 31, a top plate 32 disposed on a top edge of the blind body 31, and a bottom plate 33 disposed on a bottom edge of the blind body 31. The cord-winding device of this embodiment includes a base seat 4, an adjustment unit 5 and a lift cord 6.

The base seat 4 includes a base body 41 extending along a longitudinal direction (X), and a first end cap 42 and a second end cap 43 spaced apart from each other along the longitudinal direction (X) and respectively mounted on and covering two opposite transverse ends of the base body 41. The base body 41 includes a base bottom wall 411 extending along the longitudinal direction (X), and two base side walls 412 respectively extending upward from two opposite longitudinal ends of the base bottom wall 411. The base bottom wall 411 and the base side walls 412 cooperate to define a slide channel 413 that extends along the longitudinal direction (X). The base bottom wall 411 has two through holes 414 spaced apart in the longitudinal direction (X) and extending therethrough in a top-bottom direction, and a mounting portion 415 provided on a bottom side thereof and configured to removably mount the top plate 32 thereto. Each base side wall 412 has a slide rail 416 aligned with the slide rail 416 of the other base side wall 412. The slide rail 416 of each base side wall 412 is in the form of a slide groove that extends along the length of a respective base side wall 412. The second end cap 43 has an orifice 431.

Figure 3:
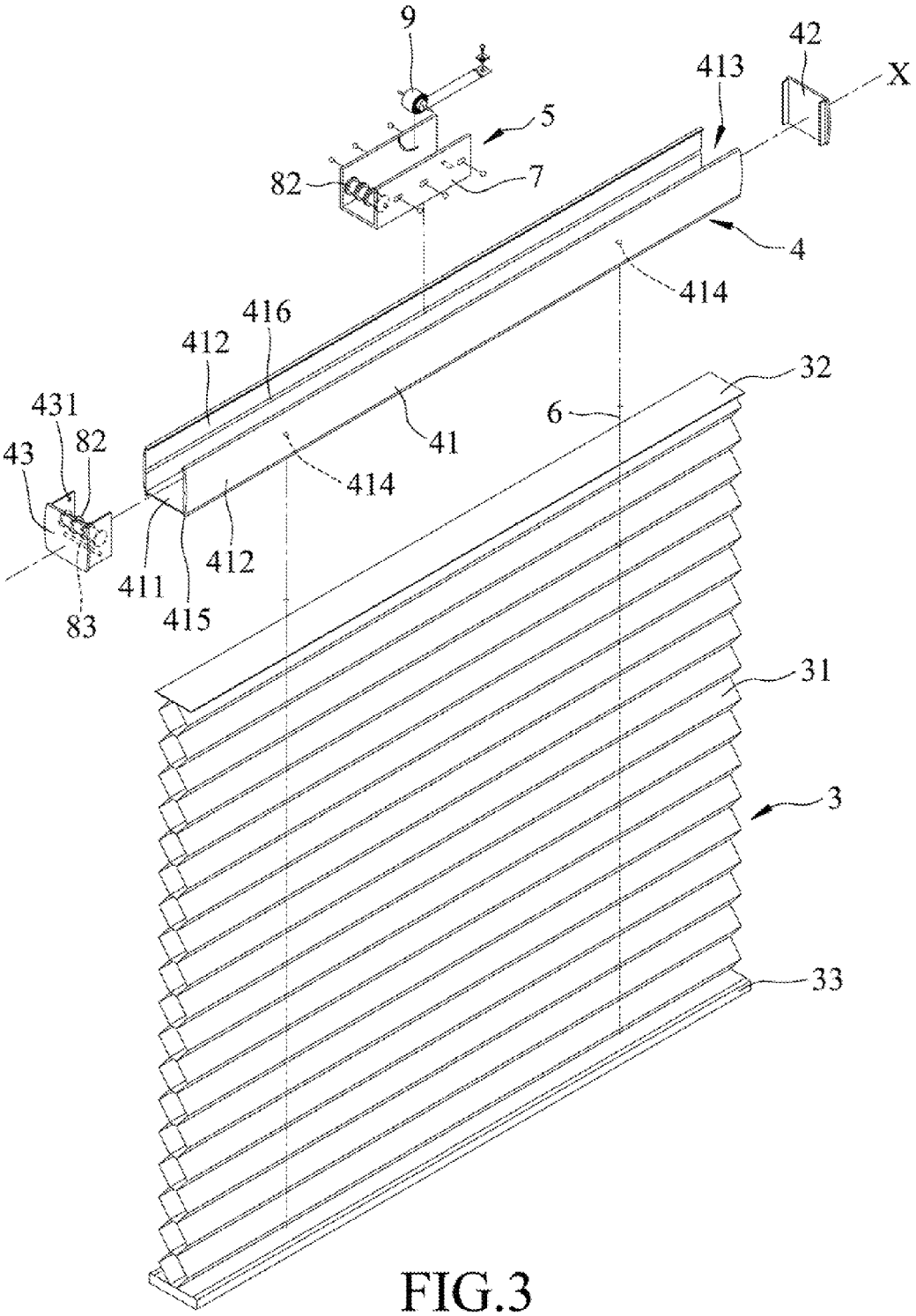
FIG. 3 is an exploded perspective view of a cord-winding device according to the embodiment of the present disclosure prior to being installed on a blind assembly having no pull cord.
Figure 5:
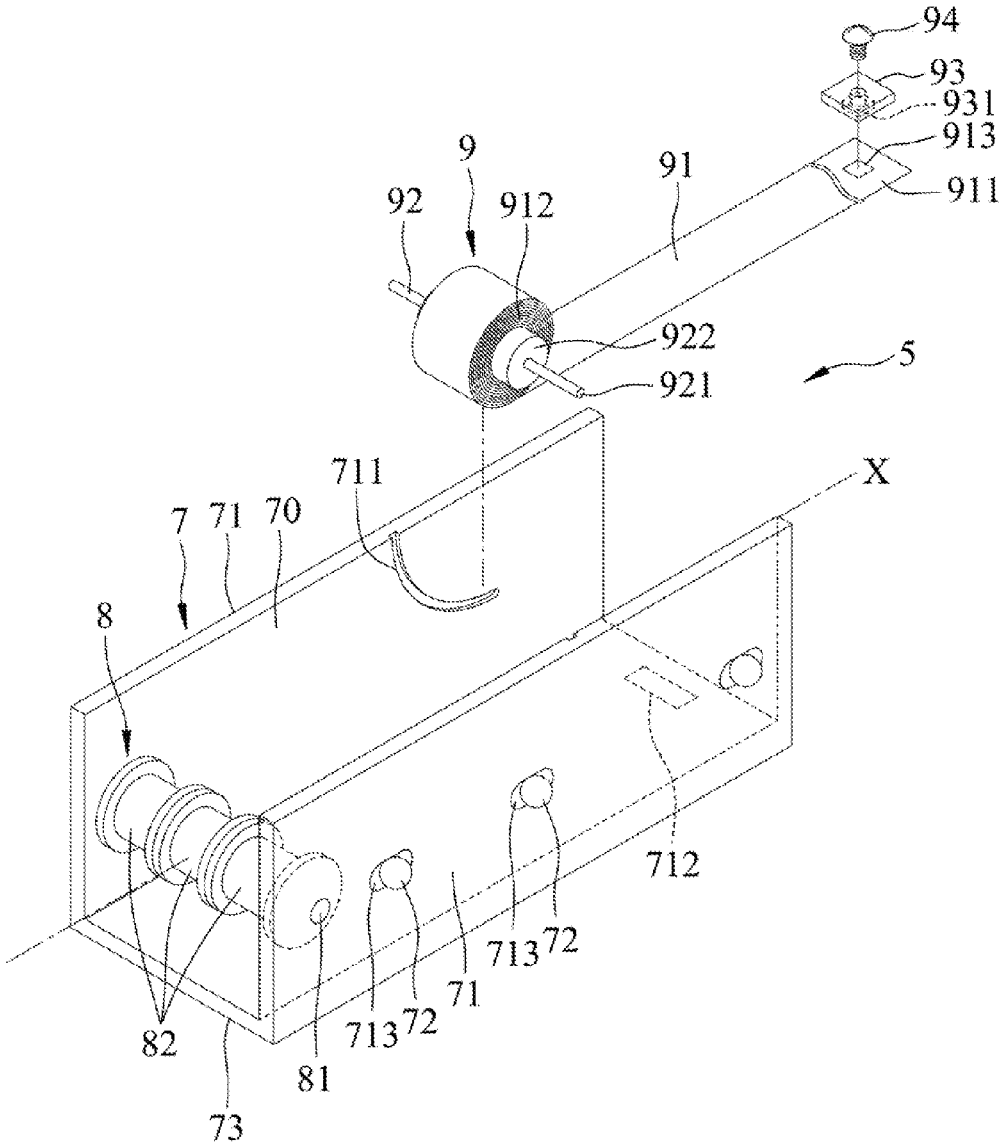
FIG. 5 is a partly exploded perspective view of an adjustment unit of the embodiment.

With reference to FIGS. 3 and 5, the adjustment unit 5 includes a slide seat, a roller set 8 and a spring unit 9.

The slide seat 7 includes a slide body 70 and a plurality of roller balls 72. The slide body 70 is mounted slidably in the slide channel 413, and includes two opposite slide side walls 71, and a slide bottom wall 73 connected between the slide side walls 71 and formed with an elongated limiting hole 712 that extends therethrough. Each of the slide side walls 71 has an inner surface formed with an engaging groove 711, and an outer surface formed with a plurality of elongated recesses 713 that are spaced apart from each other in the longitudinal direction (X). The engaging grooves 711 of the slide side walls 71 are symmetrically aligned with each other. The roller balls 72 are respectively received in the elongated recesses 713 in the slide side walls 71. The slide rails 416 of the base side walls 412 provide sliding movement of the roller balls 72 thereon, and limit the sliding movement of the slide seat 7 along the longitudinal direction (X).

The roller set 8 includes two roller axles 81 respectively mounted on the second end cap 43 and the slide body 71 in a direction that is transverse to the longitudinal direction (X), a plurality of rollers 82 respectively and rotatably mounted on the roller axles 81, and a pin 83 mounted on the second end cap 43 and parallel to the roller axle 81 that is mounted on the second end cap 43. In this embodiment, three rollers 82 are mounted on each of the roller axles 81.

The spring unit 9 includes a constant force spring 91, a pivot shaft 92, a pad 93 and a fastener 94. The constant force spring 91 has a characteristic that is suitable for use in a small space, and can provide a constant elastic force within an effective length of travel. Furthermore, because the constant force spring 91 is a roiled spring, it is less likely to produce friction when stretched so as to ensure its smooth operation. In this embodiment, the constant force spring 91 has a spiral shape, and has a first end 911 extending outward and formed with a noncircular lock hole 913, and a second end 912 spiraling inward.

The pivot shaft 92 includes a shaft member 921 having two opposite ends engaged respectively, slidably and rotatably to the engaging grooves 711 in the slide side walls 71, and a fixing member 922 mounted coaxially on the shaft member 921. The fixing member 922 has an outer diameter larger than that of the shaft member 921. The second end 912 of the constant force spring 91 is fixed to the fixing member 922. The pad 93 has a protrusion 931 projecting from a bottom end thereof.

To assemble the spring unit 9 on the slide seat 7, the two opposite ends of the shaft member 921 are first inserted into the engaging grooves 711 of the slide side walls 71 so that the shaft member 921 together with the constant force spring 91 can enter the slide body 70 via the engaging grooves 711. Next, the first end 911 of the constant force spring 91 is inserted into the limiting hole 712 and extends out of the slide body 70, after which the protrusion 931 of the pad 93 is inserted into the lock hole 913, and the fastener 94 is used to fixed the first end 911 to the base bottom wall 411. In this embodiment, the engaging grooves 711 extend upwardly and curvedly in a direction away from the limiting hole 712 so as to prevent the shaft member 921 from sliding out of the engaging grooves 711 during operation. Further, the lock, hole 913 and the pad 93 are generally square in shape, that is noncircular, so as to prevent the constant force spring 91 from rotating about the fastener 94. Moreover, the limiting hole 712 can also prevent rotation of the constant force spring 91. In addition, the slide seat 7 is restricted to slide along the longitudinal direction (X) to ensure movement and force output of the constant force spring 91 along the longitudinal direction (X). It is evident that the spring unit 9 may only include the constant force spring 91. In this case, the constant, force spring 91 is disposed above the limiting hole 712, and the first end 911 thereof is fixed to the base bottom wall 411 after extending through the limiting hole 712. When the slide body 70 of the slide seat 7 moves, the limiting hole 712 can also assist in driving the constant force spring 91 to stretch along the longitudinal direction (X).

Figure 4:
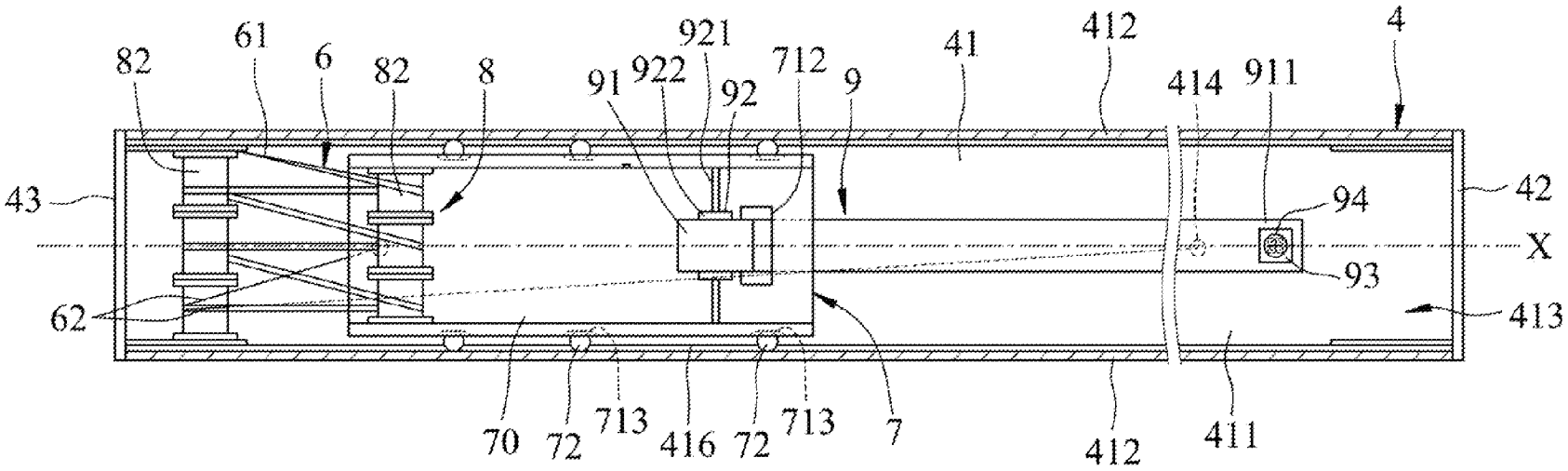
FIG. 4 is a top sectional view of the embodiment in an assembled state.
Figure 6:
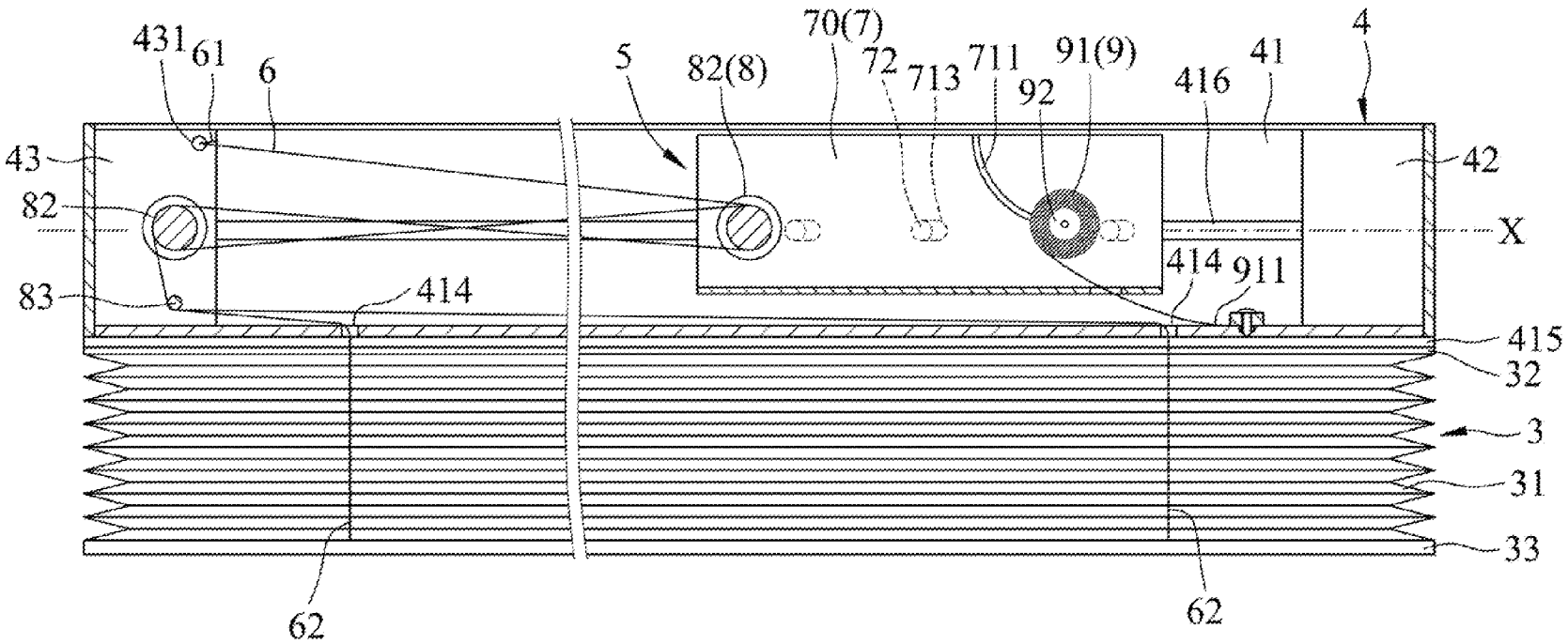
FIG. 6 is an assembled side sectional view of the embodiment, illustrating a slide seat of the embodiment in a first position.

With reference to FIGS. 4 and 6, the lift cord 6 has a fixed intermediate section 61 fixed to the orifice 431 of the second end cap 43, and two cord end sections 62 extending outwardly and respectively from two opposite ends of the fixed intermediate section 61. The cord end sections 62 extend parallel to each other, wind around the rollers 82, pass around the pin 83, and then extend through the through holes 414, respectively, through the top plate 32 and the blind body 31, and finally, are fixed to the bottom plate 33. It is worth to mention herein that the pin 83 is located lower than the rollers 82 and the slide bottom wall 73 so as to prevent the lift cord 6 from frictional contact with the slide seat 7. It is evident that a roller may be additionally provided on the pin 83 to further reduce friction.

Figure 7:
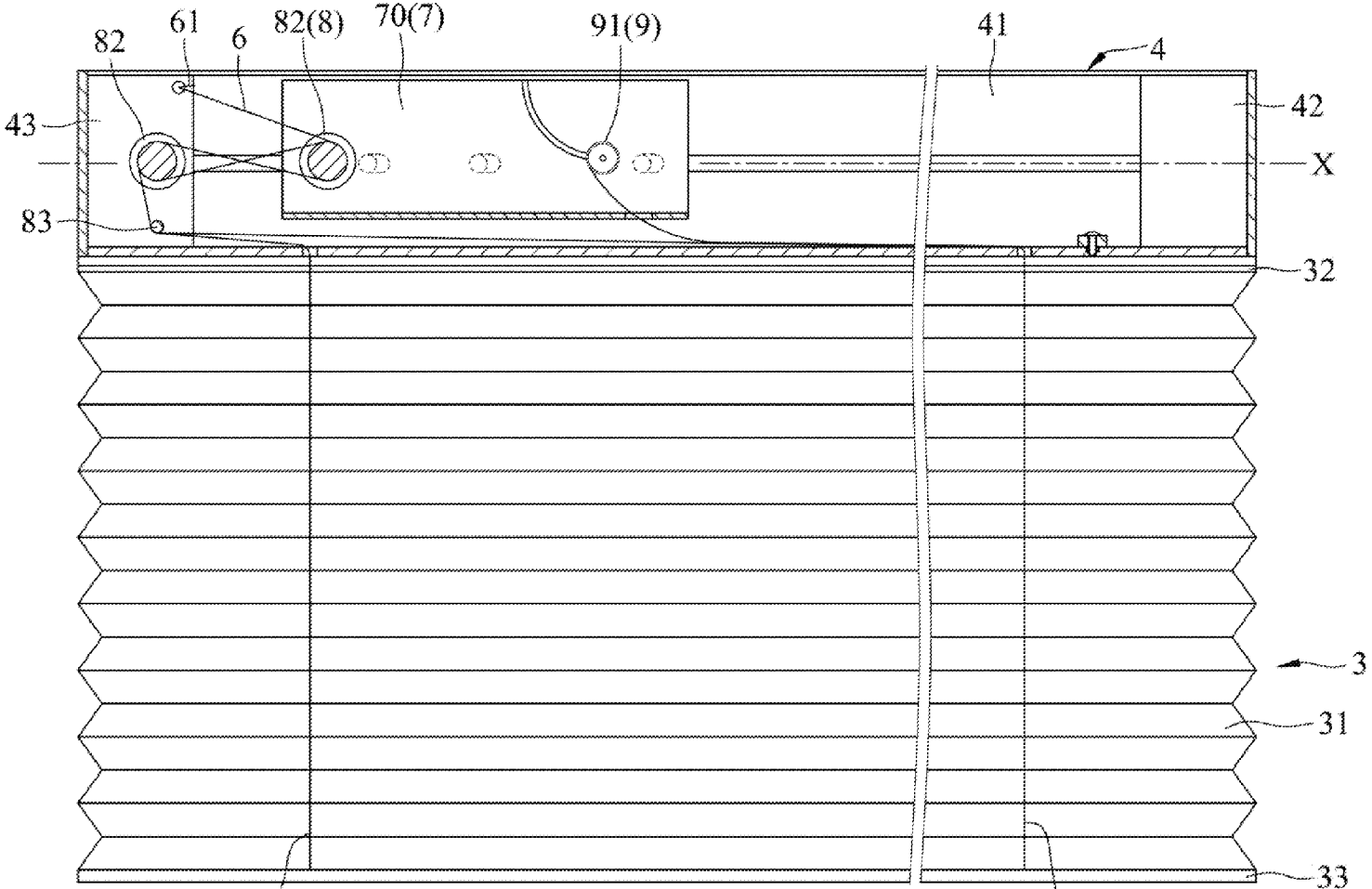
FIG. 7 is a view similar to FIG. 6, but illustrating the slide seat in a second position.

The slide seat 7 is movable relative to the base seat 4 between a first position, as shown in FIG. 6, and a second position, as shown in FIG. 7. The extent to which the Mind body 31 is raised or lowered is determined by the length of the unwound lift cord 6. Therefore, by changing the position of the slide seat 7, the length of the unwound lift cord 6 can be adjusted for raising or lowering the blind body 31. With reference to FIG. 6, in the first position, the slide seat 7 is proximate to the first end cap 42, and a major portion of the lift cord 6 is wound between the rollers 82. The blind body 31 is pulled upward to a compact raised position at this time. With reference to FIG. 7, in the second position, the slide seat 7 is proximate to the second end cap 43, and a major portion of the lift cord 6 is lowered. The blind body 31 is in a completely lowered position at this time.

Under a normal state, the base seat 4 is fixed to a window, and the blind assembly 3 is in the lowered position. The lift cord 6 supports the weight of the blind body 31 to thereby generate a pulling force that pulls the slide seat 7. The slide seat 7, in turn, pulls the constant force spring 91 so that the constant force spring 91 generates a resilient restoring force. The resilient restoring force counteracts the pulling force of the lift cord 6 to achieve a force-balanced state, so that the movement of the slide seat 7 is stopped or arrested. It is worth to mention herein that, in the absence of an external force, regardless of the amount of stretching of the constant force spring 91, the resilient restoring force thereof is constant, so that the resilient restoring force remains balanced with the pulling force of the lift cord 6. Thus, the slide seat 7 can also remain at any location between the first and second positions.

In use, when it is desired to lower the blind assembly 3, an external force is applied to pull down the bottom plate 33 of the blind assembly 3 so as to increase the pulling force of the lift cord 6 and resist the resilient restoring force, so that the slide seat 7 can be pulled by the lift cord 6 to move from the first position shown in FIG. 6 to the second position shown in FIG. 7. When the slide seat 7 moves to the second position, the cord end sections 62 of the lift cord 6 are unwound and lowered, thereby causing the blind body 31 to lower and expand. After the external force is released, the resilient restoring force is again balanced with the pulling force of the lift cord 6 to thereby maintain the blind assembly 31 in the lowered position.

When it is desired to raise the blind assembly 3, an external force is applied to push the bottom plate 33 so as to reduce the pulling force of the lift cord 6 and change the force-balanced state, so that the resilient restoring force can pull the slide seat 7 to move from the second position to the first position. The constant force spring 91 and the cord end sections 62 of the lift cord 6 are in a wound state at this time. That is, the cord end sections 62 of the lift cord 6 are wound back around the rollers 82 to raise the blind body 31. After the external force is released, the force-balanced state is restored, and the blind body 31 is in the raised position.

Using the same principle, when it is desired to maintain the blind assembly 3 in any appropriate position, an external force is applied on the bottom plate 33 of the blind assembly 3, and is then released after the appropriate position of the blind body 31 is reached.

It should be noted herein that, if the blind assembly 3 is large or heavy, the blind assembly 3 of this embodiment may be provided with two or more constant force springs 91 to increase the total resilient restoring force for supporting the weight of the blind body 31. The constant force springs 91 may be arranged side by side or staggered in a front-rear direction on the slide seat 7, and the first end 911 of each of the constant force springs 91 may be fixed to the base body 41.

From the aforesaid description, the advantages of the cord-winding device according to this disclosure can be summarized as follows:

1) The cord-winding device of this disclosure is in a force-balanced state when no external force is present, so that by simply exerting an external force that is sufficient to change the force-balanced state, the blind assembly 3 can be adjusted. Hence, use of this disclosure is easy and convenient. Further, the constant force spring 91 with a constant restoring force is used in this embodiment, so that a stable force can be exerted during use thereof, and the operation thereof can be smooth.

2) In comparison with the prior arts, this disclosure uses lesser components to achieve the effect of adjusting the blind assembly 3 without using the pull cord, so that the assembly thereof is simple and can simultaneously lower the manufacturing and assembly costs.

3) Because the constant force spring 91 is suitable for use in a small space, coupled with less components used in this disclosure, the present disclosure is applicable for a small type of blind assembly 3. This can be a breakthrough for the small blind assembly 3 having no pull cord in the prior arts which have size restrictions. On the other hand, if the present disclosure is to be applied to a blind assembly 3 with a large size, the number of the constant force spring 91 can be increased to counterbalance the weight of the blind body 31. All in all, this disclosure can provide the blind assembly 3 with a variety of selections, so that the blind assembly 3 is highly competitive.

4) The disposition of the roller set 8 can reduce friction between the lift cord 6 and the rollers 82 or between the lift cord 6 and the other components, so that the service life of the lift cord 6 can be effectively prolonged, and the overall operation can become smooth.

5) The operation of this disclosure is simple and convenient. A user only has to use his/her hand to exert a force on the bottom plate 33 to change the length of the blind body 31. When the user's hand is released, the blind body 31 stops at a new position. Hence, there is no need for additional provision of a pull cord for controlling the raising and lowering of the blind body 31, so that the hazard associated in using the pull cord can be avoided.

6) The cord-winding device of this disclosure can be made at a lower cost, and can be used in different sizes of the blind assemblies.

While the disclosure has been described in connection with what is considered the most practical embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A cord-winding device for a blind assembly having no pull cord, said cord-winding device comprising:

a base seat extending along a longitudinal direction and defining a slide channel that extends along the longitudinal direction, said base seat having a bottom side configured to removably mount the blind assembly thereto;

an adjustment unit including a slide seat mounted slidably in said slide channel, a roller set including a plurality of rollers mounted on said base seat and said slide seat, respectively, and a spring unit including a constant force spring that has a first end fixed to said base seat and a second end fixed to said slide seat; and a lift cord winding around said rollers and extending through said base seat, said lift cord being configured to extend through the blind assembly after extending through said base seat so as to be positioned to said base seat and the blind assembly, said lift cord being configured to support the weight of the blind assembly to thereby generate a pulling force to pull said slide seat, said slide seat in turn pulling said constant force spring so that said constant force spring generates a resilient restoring force, the resilient restoring force counteracting the pulling force of said lift cord to achieve a force-balanced state, wherein said first end of said constant force spring is formed with a noncircular lock hole, said spring unit further including a pad that has a protrusion inserted into said lock hole, and a fastener to fix said first end of said constant force spring to said base seat.

2. The cord-winding device as claimed in claim 1, wherein said base seat includes a base body, and a first end cap and a second end cap spaced apart from each other along the longitudinal direction and respectively mounted on and covering two opposite ends of said base body, said roller set further including two roller axles respectively mounted on said second end cap and said slide seat, said rollers being respectively and rotatably mounted on said roller axles.

3. A cord-winding device for a blind assembly having no pull cord, said cord-winding device comprising:

a base seat extending along a longitudinal direction and defining a slide channel that extends along the longitudinal direction, said base seat having a bottom side configured to removably mount the blind assembly thereto;

an adjustment unit including a slide seat mounted slidably in said slide channel, a roller set including a plurality of rollers mounted on said base seat and said slide seat, respectively, and a spring unit including a constant force spring that has a first end fixed to said base seat and a second end fixed to said slide seat; and a lift cord winding around said rollers and extending through said base seat, said lift cord being configured to extend through the blind assembly after extending through said base seat so as to be positioned to said base seat and the blind assembly, said lift cord being configured to support the weight of the blind assembly to thereby generate a pulling force to pull said slide seat, said slide seat in turn pulling said constant force spring so that said constant force spring generates a resilient restoring force, the resilient restoring force counteracting the pulling force of said lift cord to achieve a force-balanced state, wherein said base seat includes a base body, and a first end cap and a second end cap spaced apart from each other along the longitudinal direction and respectively mounted on and covering two opposite ends of said base body, said roller set further including two roller axles respectively mounted on said second end cap and said slide seat, said rollers being respectively and rotatably mounted on said roller axles, and wherein said base body includes a base bottom wall extending along the longitudinal direction and having said bottom side, and two base side walls extending upwardly and respectively from two opposite longitudinal ends of said base bottom wall, said base bottom wall and said base side walls cooperating to define said slide channel, each of said base side walls having a slide rail aligned with said slide rail of the other said base side wall, said slide seat including a slide body and a plurality of roller balls, said slide body including two slide side walls each of which has an outer surface formed with a plurality of elongated recesses that are spaced apart from each other in the longitudinal direction, said roller balls being respectively received in said elongated recesses in said slide side walls, said slide rails of said base side walls providing sliding movement of said roller balls thereon and limiting sliding movement of said slide seat along the longitudinal direction.

4. The cord-winding device as claimed in claim 3, wherein each of said slide side walls further has an inner surface formed with an engaging groove aligned with said engaging groove of the other said slide side wall, said spring unit further including a pivot shaft fixed to said second end of said constant force spring and mounted rotatably and slidably on said engaging grooves of said slide side walls.

5. The cord-winding device as claimed in claim 4, wherein said pivot shaft includes a shaft member mounted rotatably and slidably on said engaging grooves of said slide side walls, and a fixing member fixed to said second end of said constant force spring.

6. The cord-winding device as claimed in claim 3, wherein said slide body further includes a slide bottom wall between said slide side walls and formed with a limiting hole that extends therethrough, said first end of said constant force spring being fixed to said base seat after extending through said limiting hole.

7. The cord-winding device as claimed in claim 3, wherein said base bottom wall has a mounting portion provided on said bottom side and configured to removably mount the blind assembly thereto.

8. The cord-winding device as claimed in claim 3, wherein the blind assembly includes a blind body, a top plate mounted on a top edge of the blind body, and a bottom plate mounted on a bottom edge of the blind body, said base bottom wall having two through holes spaced apart in the longitudinal direction and extending therethrough in a top-bottom direction, said lift cord having a fixed intermediate section fixed to said second end cap, and two cord end sections extending outwardly and respectively from two opposite ends of said fixed intermediate section, said cord end sections extending parallel to each other, winding around said rollers, and then extending through said through holes, respectively, through the top plate and the blind body, and finally being configured to be positioned to the bottom plate.

9. The cord-winding device as claimed in claim 8, wherein said roller set further includes a pin mounted on said second end cap in a direction transverse to the longitudinal direction, said cord end sections of said lift cord extending parallel to each other, winding around said rollers, passing around said pin, and then extending through said through holes, respectively, said pin being located lower than said slide seat to prevent frictional contact between said lift cord and said slide seat.

* * * * *